US009127407B2

(12) United States Patent
Webb et al.

(10) Patent No.: US 9,127,407 B2
(45) Date of Patent: Sep. 8, 2015

(54) SIZING COMPOSITION

(71) Applicant: HEWLETT-PACKARD DEVELOPMENT COMPANY, L.P., Fort Collins, CO (US)

(72) Inventors: Steven L. Webb, Murrieta, CA (US); John L. Stoffel, San Diego, CA (US); John C. Helfrick, San Diego, CA (US); Silke Courtenay, Temecula, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 86 days.

(21) Appl. No.: 13/863,098

(22) Filed: Apr. 15, 2013

(65) Prior Publication Data

US 2014/0305606 A1 Oct. 16, 2014

(51) Int. Cl.

| | |
|---|---|
| ***D21H 21/16*** | (2006.01) |
| ***D21H 17/14*** | (2006.01) |
| ***D21H 21/38*** | (2006.01) |

(52) U.S. Cl.

CPC ..... *D21H 21/16* (2013.01); *D21H 17/14* (2013.01); *D21H 21/38* (2013.01)

(58) Field of Classification Search

USPC ..... 162/158, 160–162, 164.1, 168.1, 175, 162/181.1–181.2, 183–185; 106/285, 106/162.1, 206.1, 400, 217.9, 401, 461, 106/471; 252/301.21; 427/157, 158; 9/648

See application file for complete search history.

(56) References Cited

U.S. PATENT DOCUMENTS

| | | | | |
|---|---|---|---|---|
| 5,961,708 | A | 10/1999 | Zetter et al. | |
| 6,472,053 | B1 | 10/2002 | Hoshino et al. | |
| 2009/0274855 | A1 | 11/2009 | Koenig et al. | |
| 2009/0317549 | A1 * | 12/2009 | Tan et al. | 427/288 |
| 2012/0121872 | A1 | 5/2012 | Koenig | |
| 2012/0311798 | A1 | 12/2012 | Klein et al. | |
| 2013/0133849 | A1 * | 5/2013 | Tan et al. | 162/158 |

FOREIGN PATENT DOCUMENTS

WO WO 00/20686 4/2000

OTHER PUBLICATIONS

BIOBAN CS-1246, Dow Chemical, web: http://www.dow.com/stle/pdfs/microbial_lit/BIOBAN_CS-1246.pdf, 2002.

KORDEK MLX BIOCIDE, Rohm and Haas, web: http://www.dow.com/assets/attachments/business/consumer_and_industrial_specialties/kordek/kordek_mlx/tds/kordek_mlx.pdf, 2007.

PROXEL GXL,accessed Apr. 17, 2013 Lonza NA Prod. web: http://www.lonza.com/products-services/microbial-control/materials-protection/by-technology/biocides/north-america-products.aspx.

* cited by examiner

*Primary Examiner* — Dennis Cordray

(74) *Attorney, Agent, or Firm* — Dierker & Associates

(57) ABSTRACT

A sizing composition includes from about 3 kg/ton to about 15 kg/ton of calcium propionate, an additive, and a balance of water. The additive is selected from the group consisting of starch, an optical brightener, a biocide, a defoamer, a surface size agent, a wet strength additive, and combinations thereof. The sizing composition has a pH ranging from 7 to 8.

15 Claims, 4 Drawing Sheets

SIZING COMPOSITION

BACKGROUND

During paper making, sizing compositions are often added to desirably affect the properties of the paper. For example, the sizing composition may improve surface absorbency for the ink or toner to be printed on the paper, may improve water repellency, and may reduce surface stickiness. Some sizing compositions include calcium chloride, which is particularly suitable for papers used in inkjet printing. In particular, soluble calcium ions dissolve into the ink upon contact, and facilitate rapid flocculation of the ink pigment, which in turn alleviates bleed between colors, and intensifies the optical density of black and the saturation of colors.

BRIEF DESCRIPTION OF THE DRAWINGS

Features and advantages of examples of the present disclosure will become apparent by reference to the following detailed description and drawings.

DETAILED DESCRIPTION

Figure 1:
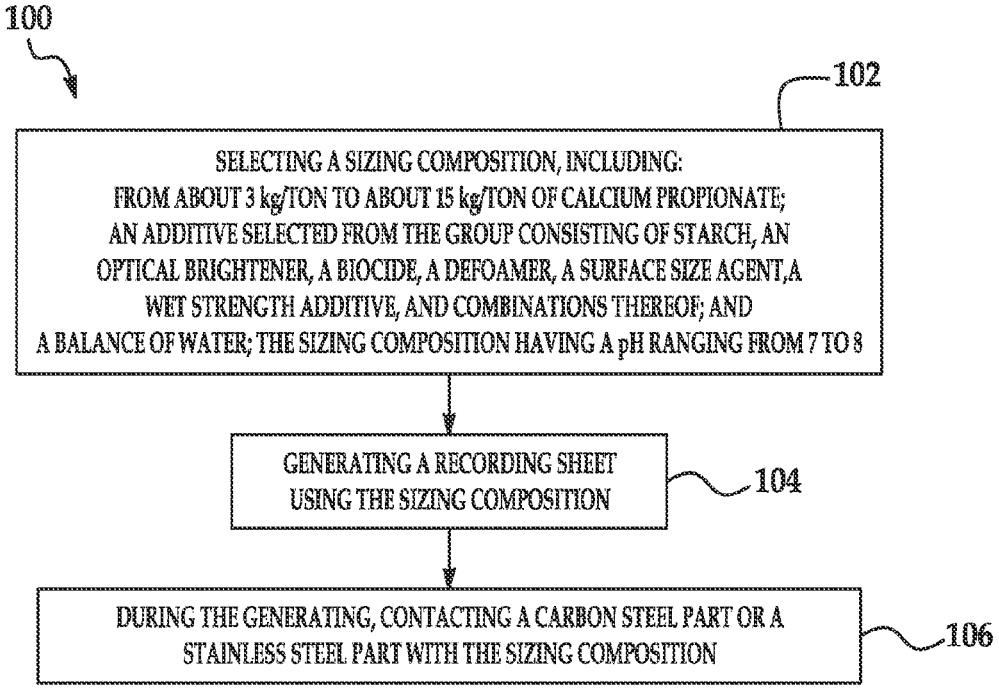
FIG. 1 is a flow diagram illustrating an example of a method for reducing corrosion in a paper making process.

While calcium chloride improves the characteristics of paper for inkjet printing, occasionally it has been found to contribute to the corrosion of parts used in the manufacturing of the paper. The contribution of calcium chloride to corrosion often occurs when the level of the chloride ions is not well controlled. The present inventors have unexpectedly found that not all calcium salts are equivalent in terms of improving paper characteristics while also reducing part corrosion. In fact, the present inventors have found that calcium propionate (also known as calcium propanoate), used alone or in combination with certain amounts of calcium chloride, provides the beneficial effect of soluble calcium ions while also being less corrosive (when compared, for example, to other calcium salts).

It has been suggested that any water soluble salt of calcium can be used in a paper sizing composition to enhance print results and reduce corrosion on the parts of a papermaking machine. Based upon this, it would be expected that calcium salts, such as calcium acetate, calcium ethylenediaminetetraacetic acid (EDTA), calcium lactate (which is slowly soluble), calcium nitrate, calcium tartrate (which is slightly soluble), and calcium stearate (which is slightly soluble), may be used in the paper sizing composition to enhance print results and reduce corrosion. The test results of the Example (s) disclosed herein illustrate that this is not the case. In fact, the results show that some water soluble salts, including calcium acetate and calcium nitrate, do not reduce corrosion of stainless steel or carbon steel as much as calcium propionate, and that calcium lactate does not reduce corrosion of carbon steel as much as calcium propionate. Other salts (e.g., calcium tartrate and calcium stearate) are believed to be unsuitable for the sizing composition at least in part because their solubility in aqueous solutions is low. Low solubility may prohibit the use of loadings that are high enough to improve print quality or may lead to other issues, such as precipitate formation.

Further, without being bound to any theory, it is believed that the blends of calcium chloride and calcium propionate create a synergistic result (at least on carbon steel) that minimizes the corrosive effects of the calcium chloride. For example, chloride used alone may cause corrosion in a size press by weakening the iron oxide passivation film at point defects, which in turn forms pitting corrosion. Pits usually have a low pH in them, and the propionate may have a buffering effect that leads to a reduction in the corrosion rate. As illustrated in the Example(s) disclosed herein, sizing compositions including from 25:75 to 75:25 of calcium propionate to calcium chloride significantly reduce corrosion on carbon steel when compared to solutions with higher amounts of calcium chloride.

Some examples of the sizing composition disclosed herein include a single calcium salt, namely calcium propionate, without any other salts. Other examples of the sizing composition disclosed herein include two calcium salts, namely calcium propionate and calcium chloride, without any other salts. Whether calcium propionate is used alone or in combination with calcium chloride, the total amount of salt ranges from about 3 kg/ton of paper to about 15 kg/ton of paper. In some examples, the total amount of salt ranges from about 5 kg/ton of paper to about 9 kg/ton of paper. The ratio of calcium propionate to calcium chloride ranges anywhere from 100:0 (i.e., no calcium chloride) to 50:50.

The composition may also include one or more additives selected from the group consisting of starch, an optical brightener, a biocide, a defoamer, a surface size agent, a wet strength additive, and a pigment filler. It is to be understood that one of these additives may be used, or any combination of the additives may be used.

Starch may be included in an amount ranging from about 15 kg/ton of paper to about 50 kg/ton of paper. The starch may be corn starch, potato starch, tapioca starch, or the like. Modified or unmodified starch may be used. Examples of modified starches include oxidized starch, ethylated starch, cationic starch, esterified starch, enzymatically denatured starch, etc. One specific example of a starch additive is 2-hydroxyethyl starch ether, which is commercially available under the tradename PENFORD® Gum 270 (Penford Products, Co.).

Examples of optical brighteners (i.e., optical brightening agent or OBA) include triazine-stilbenes (di-, tetra- or hexasulfonated), coumarins, imidazolines, diazoles, triazoles, benzoxazolines, pyrazolines, and biphenyl-stilbenes. Many commercially available optical brightening agents are based on stilbene, coumarin and pyrazoline chemistries. Some examples include 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, naphthalimides, triazinyl-pyrenes, 2-styryl-benzoxazoles, 2-styryl-naphthoxazoles, benzimidazole-benzofurans, or benzimidazole-oxanilides. The optical brightener may be included in an amount ranging from about 1 kg/ton of paper to about 10 kg/ton of paper.

When included, the biocide may be present in an amount ranging from about 0.01 kg/ton of paper to about 0.5 kg/ton of paper. Suitable biocides for the sizing composition include, for example, PROXEL® GXL (Lonza), KORDEK™ MLX (Rohm and Haas), and/or BIOBAN™ CS-1246 (The Dow Chemical Co.).

The defoamer may be included in the sizing composition in an amount ranging from about 0.01 kg/ton to about 0.5 kg/ton. Suitable defoamers are based on silica, silicone oil, polyglycol, or ethylene bis-stearamide chemistries. Examples of the defoamer include FOAMASTER® 1410, 1420, 1430, all of which are available from BASF Corp., Florham Park, N.J.

As mentioned above, the sizing composition may also include the surface size agent. This additive may be included in an amount ranging from about 0.5 kg/ton of paper to about 5 kg/ton of paper. Examples of suitable sizing agents include acrylic emulsion products, polyurethanes, styrene acrylic solutions, styrene acrylate emulsions, ethylene acrylic acids, and styrene maleic anhydride.

The sizing composition may also include the wet strength additive in an amount ranging from about 0.01 kg/ton of paper to about 0.5 kg/ton of paper. Suitable examples of the wet strength additive include dialdehyde starch and polyamine-polyamide-epichlorohydrin resins (e.g., polyamido-amine-epichlorohydrin, PEA).

In an example, the sizing composition also includes pigment filler. Examples of suitable pigment fillers include calcium carbonate (e.g., precipitated calcium carbonate (PCC) or ground calcium carbonate (GCC)), barium sulfate, clay, or titanium dioxide. When included in the sizing composition, the pigment filler may be present in any amount up to about 60% of the composition by dry weight.

The balance of the composition is water. It is to be understood that the amount of water used is sufficient to render the sizing composition with a total solids content ranging from about 8% to about 15%.

It is desirable that the pH of the sizing composition range from 7 to 8. In an example, the pH ranges from 7.2 to 7.5. If the composition is too acidic, a basic pH buffer may be added (e.g., tris(hydroxymethyl)aminomethane (TRIS)); and if the composition is too basic, an acidic pH buffer may be added. The neutral to slightly basic pH is desirable for the paper making process. An acidic pH could deleteriously contribute to higher corrosion rates. It is to be understood that enough pH buffer may be added to achieve the desirable pH.

Some examples of the sizing composition disclosed herein do not include any other components except for the listed salt(s), the listed additive(s), and water.

The sizing composition disclosed herein may be used to generate paper that is suitable for use in inkjet printing or laser printing. It is believed that the sizing composition contributes to enhanced printing performance with inkjet printing (e.g., black optical density and color gamut), and contributes to enhanced toner transfer with laser printing.

During the paper making process, the sizing composition may be used to reduce corrosion. An example of this method 100 is shown in FIG. 1. As shown at reference numeral 102, the method includes selecting the sizing composition disclosed herein.

The selected sizing composition is used to generate a recording sheet (e.g., inkjet paper, laser jet paper, etc.), as shown at reference numeral 104. During the paper making process, the sizing composition is typically added at the size press, which may be, for example, a puddle or metered size press. The sizing composition will be in continuous contact with one or more parts of the size press, as shown at reference numeral 106. The sizing composition may also splash outside of the size press when the paper machine is run at high throughput rates. At least some of the parts touched by the size press solution may be formed of stainless steel or carbon steel, which are susceptible to corrosion. As will be illustrated in the Examples, the sizing composition disclosed herein exhibits particularly desirable results with respect to corrosion of the size press parts.

In addition to the sizing composition, the recording sheet/paper that is formed may include fibers (e.g., chemically or thermal mechanically pulped hardwood and/or softwood fibers) and fillers (e.g., titanium dioxide ($TiO_2$), precipitated calcium carbonate, ground calcium carbonate, talc, clay (e.g., calcined clay, kaolin clay, or other phyllosilicates), calcium sulfate, or combinations thereof).

To further illustrate the present disclosure, examples are given herein. It is to be understood that these examples are provided for illustrative purposes and are not to be construed as limiting the scope of the present disclosure.

EXAMPLES

Example 1

Various sizing compositions were made using a calcium salt or magnesium sulfate. The calcium salt solutions and the magnesium sulfate solution were prepared at a molar concentration equivalent to 1% w/w $CaCl_2$ solution with water. The calcium salts included calcium propionate as the sample, and calcium chloride, calcium acetate, calcium lactate, and calcium nitrate as the comparative samples. Each of the solutions included 0.1% PROXEL® GXL (Lonza) and 0.1% TRIS buffer, and the pH of each solution ranged from 7.2 to 7.5.

Electrochemical corrosion rates were measured for each of the solutions. The experiments involved linear sweep potential scans across an open circuit potential (OCP, measured system potential and zero applied voltage). The voltage was scanned from −250 mV to +250 mV across this potential region and the resulting current was plotted (in a Tafel Plot). At the OCP (taken as the intersection of the anodic and cathodic legs of the plot), the current flow $I_{corr}$ was used to calculate the corrosion rate. The corrosion rates are reported in milli-inches/year (mpy) in Table 1. All solutions were tested on fresh areas of polished metal test electrodes.

TABLE 1

| | Corrosion Rate (mils per year) | |
|---|---|---|
| Salt | 1020 Carbon Steel | 316 Stainless Steel |
| Comparative Sample $CaCl_2$ | 2.3 | 0.02 |
| Comparative Sample $MgSO_4$ | 3.2 | 0.20 |
| Comparative Sample Ca acetate | 0.3 | 0.38 |
| Sample Ca propionate | 0.2 | 0.04 |
| Comparative Sample Ca lactate | 0.6 | 0.01 |
| Comparative Sample Ca nitrate | 0.7 | 0.22 |

It is desirable that the sizing composition provide suitable corrosion rate results on both stainless steel and carbon steel. As illustrated in Table 1, calcium propionate is the only salt that provided these results. The performance of calcium chloride, magnesium sulfate, calcium lactate and calcium nitrate was poor on carbon steel, while the performance of magnesium sulfate, calcium acetate, and calcium nitrate was poor on stainless steel.

Figure 2:
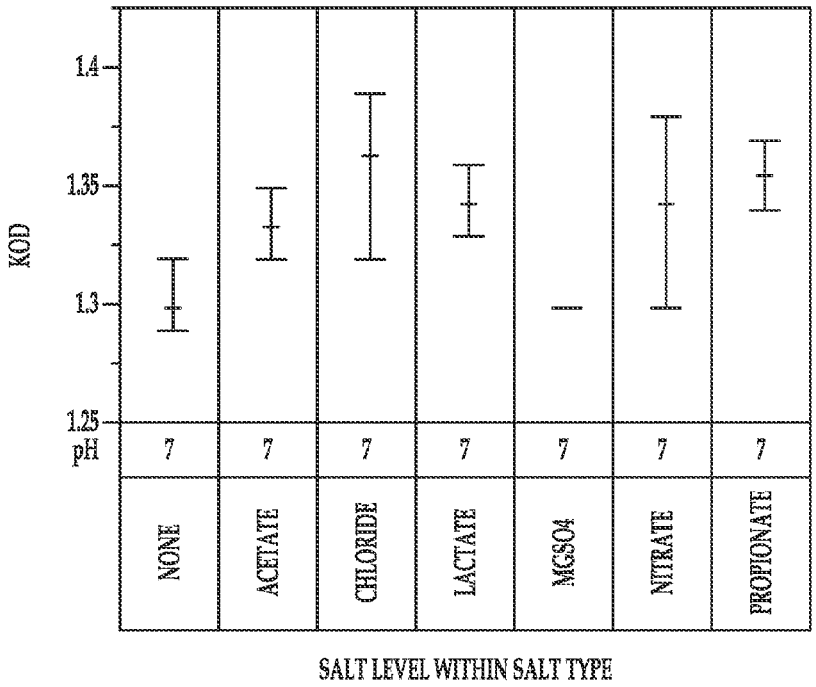
FIG. 2 is a graph illustrating the black optical density (KOD) results of various sizing compositions including different salts.
Figure 3:
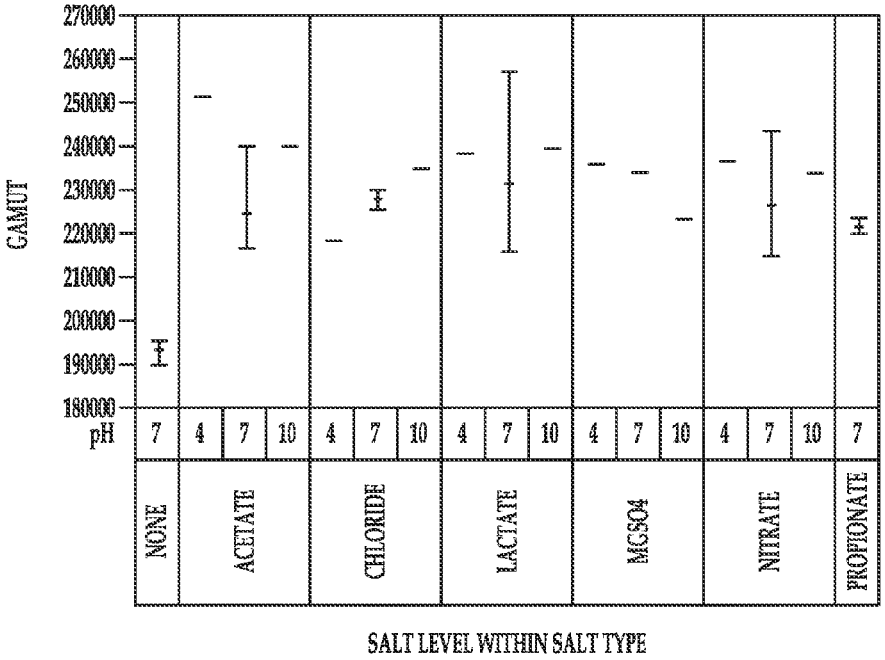
FIG. 3 is a graph illustrating gamut results of various sizing compositions including different salts.

Each of the solutions was used to treat paper. The sizing solutions were applied on both sides of a base paper to form a coating layer on each side. This process was accomplished in small quantities by hand drawdown using a Meyer rod in a plate coating station. The coat weight ranged from 2 gsm to 4 gsm total for each side. The treated papers and one untreated paper had images printed thereon. The optical density and gamut were measured for each of the papers. These results are shown, respectively, in FIGS. 2 and 3. As shown in FIG. 2, the optical density of all of the calcium treated papers was raised 0.05 to 0.10, and the optical density of the magnesium sulfate treated paper was not raised. The color gamut was raised from 5% to 10% by each of the salts. These results illustrate that desirable printing performance can be achieved when using calcium propionate.

Example 2

Various sizing compositions were made using calcium propionate, and a comparative sizing composition was made using calcium chloride. The calcium propionate solutions were made with water and included, respectively, 0.5% calcium propionate (pH 7.53), 1.0% calcium propionate (pH 7.53), 1.5% calcium propionate (pH 7.68), 2.0% calcium propionate (pH 7.50), and 2.5% calcium propionate (pH 7.70). The calcium chloride solution was a 1% w/w $CaCl_2$ solution having a pH of 7.43.

Electrochemical corrosion rates were measured for each of the solutions. The experiments involved linear sweep potential scans across an open circuit potential (OCP, measured system potential and zero applied voltage). The voltage was scanned from −200 mV to +200 mV across this potential region, and the resulting current was plotted (in a Tafel Plot). At the OCP (taken as the intersection of the anodic and cathodic legs of the plot), the current flow $I_{corr}$ was used to calculate the corrosion rate. The corrosion rates are reported in milli-inches/year (mpy) in Table 2. This data is also presented graphically in FIG. 4. All solutions were tested in duplicate on fresh areas of polished metal test electrodes. Based on the duplicates, the standard deviation was about 0.015 mpy.

TABLE 2

| Sample | | 1020 Carbon Steel | 316 Stainless Steel | pH |
|---|---|---|---|---|
| Sample 1: 0.5% | run1 | 0.03 | 0.010 | 7.53 |
| Ca Propionate | run2 | 0.045 | 0.021 | |
| Sample 2: 1.0% | run1 | 0.037 | 0.046 | 7.53 |
| Ca Propionate | run2 | 0.075 | 0.021 | |
| Sample 3: 1.5% | run1 | 0.145 | 0.025 | 7.68 |
| Ca Propionate | run2 | 0.075 | 0.017 | |
| Sample 4: 2.0% | run1 | 0.042 | 0.026 | 7.50 |
| Ca Propionate | run2 | 0.048 | 0.015 | |
| Sample 5: 2.5% | run1 | 0.03 | 0.015 | 7.70 |
| Ca Propionate | run2 | 0.026 | 0.010 | |
| Comparative | run1 | 3.91 | 0.103 | 7.43 |
| Sample: $CaCl_2$ | run2 | 3.80 | 0.048 | |

Figure 4:
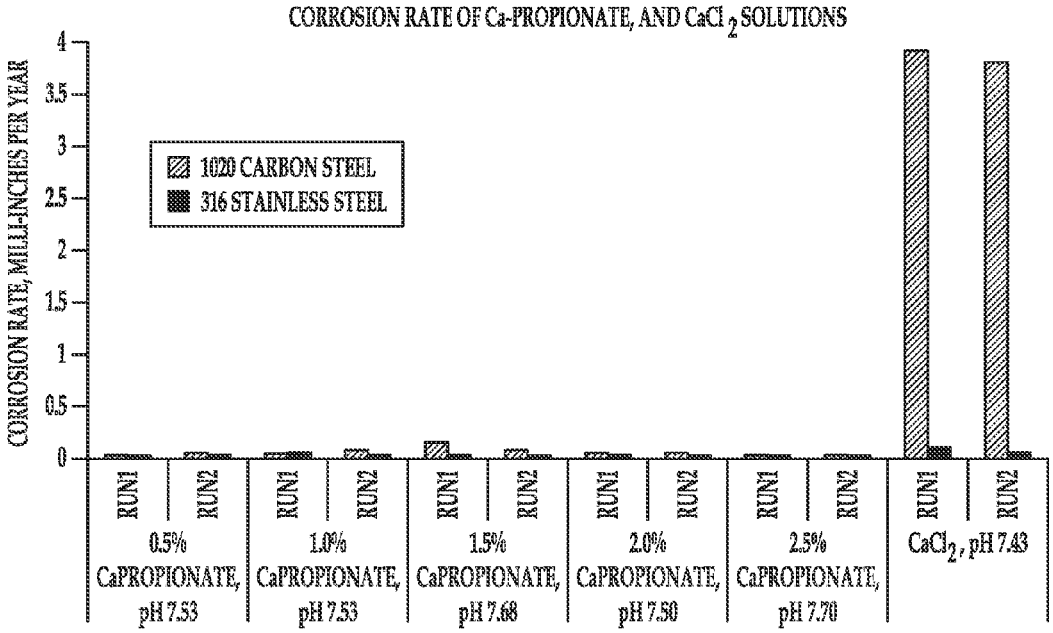
FIG. 4 is a graph illustrating the corrosion rate of calcium propionate sizing compositions having different concentrations and a calcium chloride sizing composition.

The results in Table 2 and FIG. 4 illustrate that calcium propionate significantly reduced the corrosion rate on carbon steel and slightly reduced the corrosion rate on stainless steel, when compared to calcium chloride. These results also indicate the lack of correlation between the corrosion rate and the concentration of calcium propionate.

Example 3

Various sizing compositions were made using calcium propionate, and various comparative sizing compositions were made using calcium chloride. The calcium propionate solutions were made with water, and the pH was varied using TRIS and/or acetate or sodium acetate as a pH buffer. Each of the salt solutions was 1% calcium propionate and each of the comparative salt solutions was 1% calcium chloride. Some of the solutions also included PROXEL® GXL (Lonza, referred to as "GXL" in Table 3). Table 3 lists the buffer(s) used and the pH.

Electrochemical corrosion rates were measured for each of the solutions. The experiments involved linear sweep potential scans across an open circuit potential (OCP, measured system potential and zero applied voltage). The voltage was scanned from −200 mV (in some cases up to −400 mV) to +200 mV across this potential region, and the resulting current was plotted (in a Tafel Plot). At the OCP (taken as the intersection of the anodic and cathodic legs of the plot), the current flow $I_{corr}$ was used to calculate the corrosion rate. The corrosion rates are reported in milli-inches/year (mpy) in Table 3. This data is also presented graphically in FIG. 5 for carbon steel and FIG. 6 for stainless steel. All solutions were tested in duplicate on fresh areas of polished metal test electrodes. Based on the duplicates, the standard deviation was about 0.015 mpy.

TABLE 3

| Samples and Comparative Samples | | Measured pH | Corrosion rate, mpy: 316 Stainless Steel | Corrosion rate, mpy: 1020 Carbon Steel |
|---|---|---|---|---|
| 1% Ca-Propionate | Tris + acetate | 4.81 | 0.25, 0.18 | 482 |
| | Acetate + GXL | 4.92 | 0.76 | * |
| | Acetate + GXL | 5.56 | 0.12 | * |
| | Tris + acetate | 5.66 | 0.061 | 163 |
| | Acetate + GXL | 6.76 | 0.063 | 0.087 |
| | Tris | 7.01 | 0.072 | 0.22 |
| | Tris + GXL | 7.38 | 0.053 | 0.57 |
| | Tris + GXL | 8.23 | 0.04 | 0.12, 0.10 |
| | Tris + GXL | 9.49 | 0.03 | 0.027, 0.027 |
| 1% $CaCl_2$ | NaAcetate + GXL | 4.01 | 0.65 | * |
| | Tris + acetate | 4.43 | 1.21 | 97, 81 |
| | NaAcetate + GXL | 4.96 | 0.19 | 62 |
| | Tris + acetate | 5.39 | 0.3 | 78 |
| | NaAcetate + GXL | 6.37 | 0.019 | 0.58 |
| | Tris | 6.98 | 0.026 | 1.06, 2.6 |
| | Tris + GXL | 8.22 | 0.017 | 2.4 |
| | Tris + GXL | 9.44 | 0.041 | 0.162 |

* at low pH some corrosion rates were indeterminate due to Proxel reduction

Figure 5:
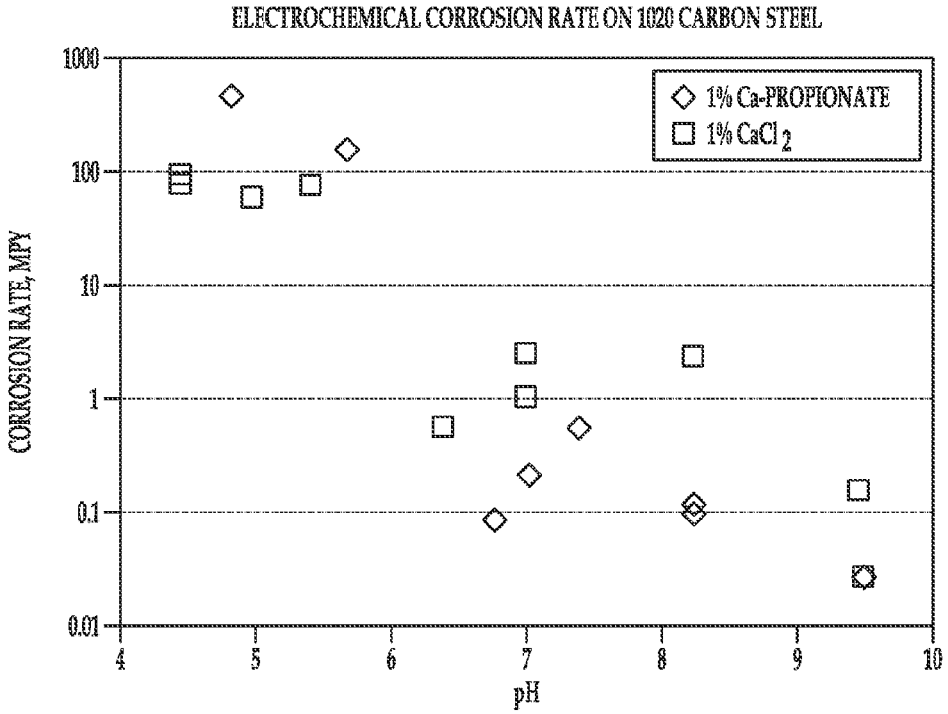
FIG. 5 is a graph illustrating the effect of pH on the corrosion rate of a calcium propionate sizing composition and a calcium chloride sizing composition on carbon steel.
Figure 6:
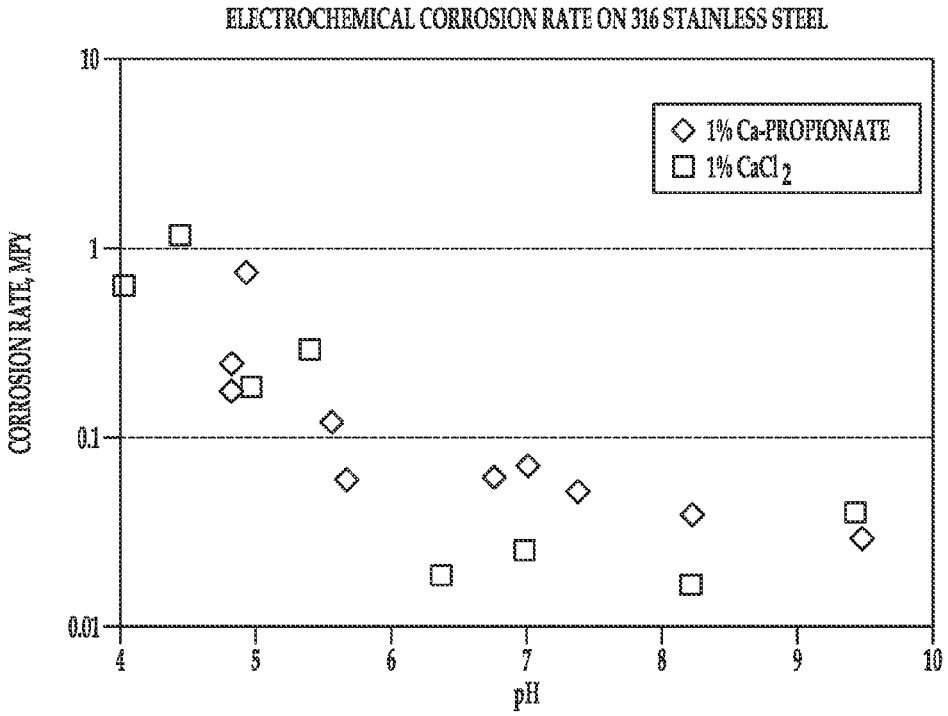
FIG. 6 is a graph illustrating the effect of pH on the corrosion rate of a calcium propionate sizing composition and a calcium chloride sizing composition on stainless steel.

These results illustrate a general increase in corrosion rates with increasing acidity. These results also illustrate that the corrosion rates on the stainless steel are much lower than the corrosion rates on carbon steel. In FIGS. 5 and 6, the results are plotted on a logarithmic scale for corrosion rates as these varied over a wide range from about 0.02 mpy to about 400 mpy.

Acid enhanced corrosion occurred at pH below 6, and thus it appears that there is little difference between calcium chloride and calcium propionate. However, in viewing the higher pH data (i.e., pH≥6.5) separately, the data suggests that the corrosion rate for the chloride salt on carbon steel was higher than the corrosion rate for the propionate salt on carbon steel. Both salts exhibited suitable corrosion rates on stainless steel in this Example.

Example 4

Blends

Various sizing compositions were made using different blends of calcium propionate and calcium chloride. In addition, one sizing composition was made with calcium propionate and without calcium chloride, while another sizing composition was made with calcium chloride and without calcium propionate. The solutions were prepared at a molar concentration equivalent to 1% w/w $CaCl_2$ solution with water. The percentage of the respective salts used, and the pH of each composition is shown in Table 4.

Figure 7:
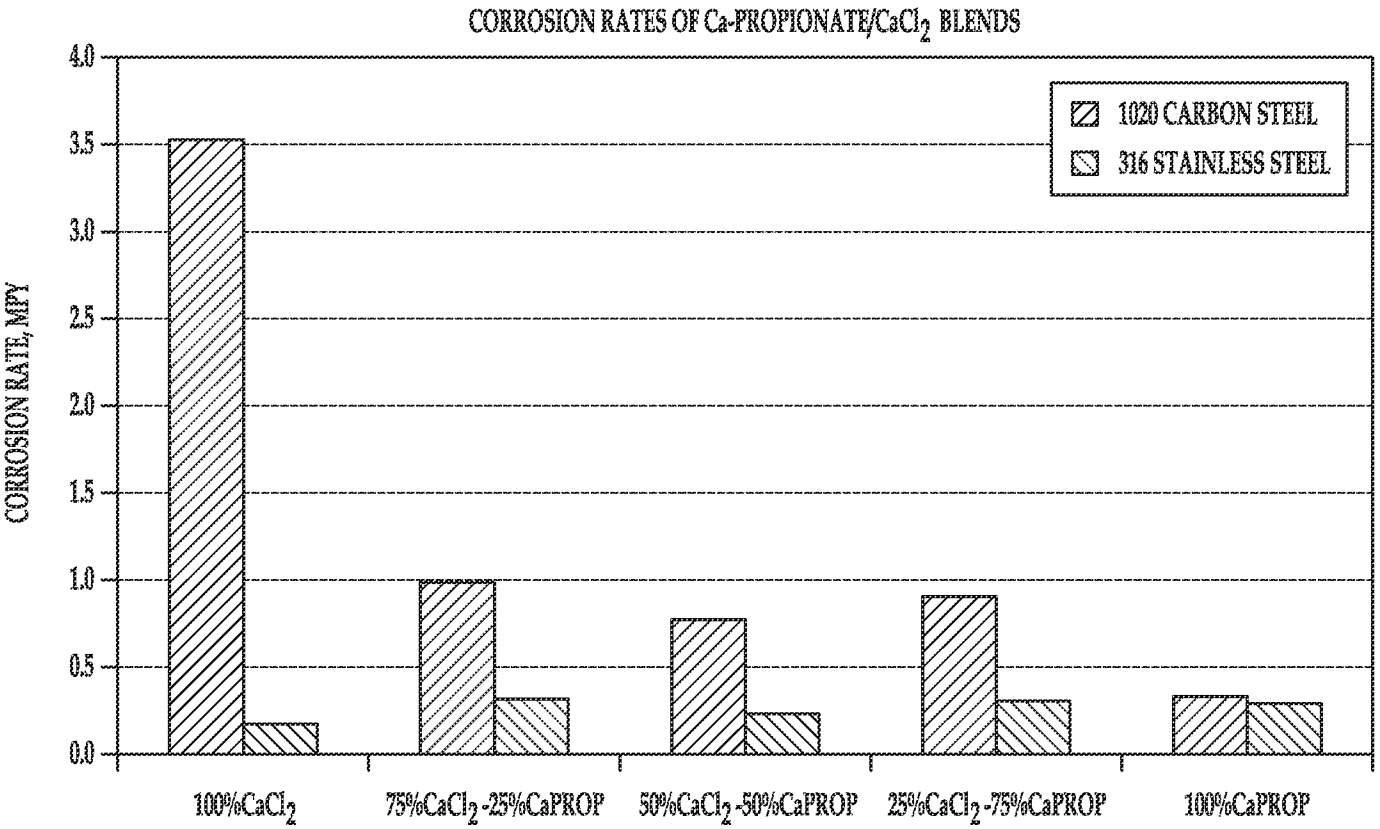
FIG. 7 is a graph illustrating the corrosion rate of sizing compositions having different percentages of calcium propionate and calcium chloride.

Electrochemical corrosion rates were measured for each of the solutions. The experiments involved linear sweep potential scans across an open circuit potential (OCP, measured system potential and zero applied voltage). The voltage was scanned from −200 mV to +200 mV across this potential region and the resulting current was plotted (in a Tafel Plot). At the OCP (taken as the intersection of the anodic and cathodic legs of the plot), the current flow $I_{corr}$ was used to calculate the corrosion rate. The corrosion rates are reported in milli-inches/year (mpy) in Table 4. This data is also presented graphically in FIG. 7.

TABLE 4

| Sample | 1020 Carbon Steel | 316 Stainless Steel | pH |
|---|---|---|---|
| 100% Ca Chloride | 3.53 | 0.16 | 7.05 |
| 75% Ca Chloride: 25% Ca Propionate | 0.99 | 0.31 | 7.04 |
| 50% Ca Chloride: 50% Ca Propionate | 0.81 | 0.22 | 7.27 |
| 25% Ca Chloride: 75% Ca Propionate | 0.90 | 0.30 | 7.29 |
| 100% Ca Propionate | 0.32 | 0.28 | 7.24 |

For a blend of calcium propionate with calcium chloride, it is desirable that the sizing composition provide suitable corrosion rate results on both stainless steel and carbon steel. As illustrated in Table 4, blends of 75% or less of calcium chloride and 25% or more of calcium propionate exhibited much less corrosion on carbon steel when compared to the sample including 100% calcium chloride, while the results for stainless steel corrosion were acceptable. It is to be understood that the threshold for determining a suitable corrosion rate may be higher for blends than for single salts, at least in part because of the presence of calcium chloride, which is believed to be more corrosive than some other salts.

It is to be understood that the ranges provided herein include the stated range and any value or sub-range within the stated range. For example, a range from about 3 kg/ton to about 15 kg/ton should be interpreted to include not only the explicitly recited limits of about 3 kg/ton to about 15 kg/ton, but also to include individual values, such as 4 kg/ton, 9 kg/ton, 13.5 kg/ton, etc., and sub-ranges, such as from about 5 kg/ton to about 10 kg/ton, from about 6 kg/ton to about 12 kg/ton, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A paper including a sizing composition, the sizing composition comprising:

calcium propionate present in an amount ranging from about 3 kg/ton of the paper to about 15 kg/ton of the paper;

an additive selected from the group consisting of starch, an optical brightener, a biocide, a defoamer, a surface size agent, a wet strength additive, a pigment filler and combinations thereof;

calcium chloride, wherein a ratio of the calcium chloride to the calcium propionate ranges from about 0:100 to about 50:50; and a balance of water;

the sizing composition having a pH ranging from 7 to 8 and improving a corrosion rate of any of carbon steel or stainless steel used in paper making with the sizing composition when compared to a corrosion rate of any of carbon steel or stainless steel used in paper making with a second sizing composition including: a salt selected from the group consisting of calcium chloride alone, magnesium sulfate, calcium acetate, calcium lactate, and calcium nitrate; the same additive as the sizing composition; and a second balance of water; wherein the salt is present in the same amount or a different amount than the calcium propionate in the sizing composition, and wherein the second sizing composition has a second pH ranging from 7 to 8;

wherein the sizing composition excludes any other salts.

2. The paper as defined in claim 1 wherein a total amount of the calcium chloride and the calcium propionate ranges from about 3 kg/ton of the paper to about 15 kg/ton of the paper.

3. The paper as defined in claim 1 wherein the composition includes from about 8% to about 15% total solids.

4. The paper as defined in claim 1 wherein any of:

starch is included in an amount ranging from about 15 kg/ton of the paper to about 50 kg/ton of the paper;

the optical brightener is included in an amount ranging from about 1 kg/ton of the paper to about 10 kg/ton of the paper;

the biocide is included in an amount ranging from about 0.01 kg/ton of the paper to about 0.5 kg/ton of the paper;

the defoamer is included in an amount ranging from about 0.01 kg/ton of the paper to about 0.5 kg/ton of the paper;

the surface size agent is included in an amount ranging from about 0.5 kg/ton of the paper to about 5 kg/ton of the paper; or the wet strength additive is included in an amount ranging from about 0.01 kg/ton of the paper to about 0.5 kg/ton of the paper.

5. The paper as defined in claim 1 wherein a total amount of the calcium chloride and the calcium propionate ranges from about 5 kg/ton of the paper to about 9 kg/ton of the paper.

6. The paper as defined in claim 1 wherein the pigment filler is included in the composition in an amount that is up to about 60% of the composition by dry weight.

7. The paper as defined in claim 1 wherein:

the ratio of the calcium chloride to the calcium propionate ranges from greater than 0:100 to about 50:50; and the sizing composition improves the corrosion rate of the any of the carbon steel or stainless steel used in paper making with the sizing composition when compared to the corrosion rate of the any of the carbon steel or stainless steel used in paper making with the second sizing composition including calcium chloride alone as the salt, wherein the calcium chloride amount in the second sizing composition is greater than the calcium chloride amount in the sizing composition.

8. The paper as defined in claim 1 wherein the amount of the calcium propionate in the sizing composition is the same as the amount of salt in the second sizing composition.

9. A sizing composition to be incorporated into a paper, the sizing composition consisting of:

a calcium salt in a solution prepared at a molar concentration equivalent to 1% w/w $CaCl_2$ solution with water, the calcium salt being calcium propionate and calcium chloride present in a ratio ranging from 100:0 to 50:50;

an additive selected from the group consisting of starch, an optical brightener, a biocide, a defoamer, a surface size agent, a wet strength additive, a pigment filler, and combinations thereof; and a balance of water;

the sizing composition having a pH ranging from 7 to 8.

10. The sizing composition as defined in claim 9 wherein any of:

starch is included in a ratio of starch to calcium salt from about 15:3 to about 50:15;

the optical brightener is included in a ratio of optical brightener to calcium salt from about 1:3 to about 10:15;

the biocide is included in a ratio of biocide to calcium salt from about 0.01:3 to about 0.5:15;

the defoamer is included in a ratio of defoamer to calcium salt from about 0.01:3 to about 0.5:15;

the surface size agent is included in a ratio of surface size agent to calcium salt from about 0.5:3 to about 5:15;

the wet strength additive is included in a ratio of wet strength additive to calcium salt from about 0.01:3 to about 0.5:15; or the pigment filler is included in an amount up to about 60% of the composition by dry weight.

11. The sizing composition as defined in claim 9 wherein the composition includes from about 8% to about 15% total solids.

12. A method for reducing corrosion during paper making, comprising:

selecting a sizing composition for inclusion in a recording sheet, the sizing composition including:

calcium propionate, alone or in combination with calcium chloride;

an additive selected from the group consisting of starch, an optical brightener, a biocide, a defoamer, a surface size agent, a wet strength additive, a pigment filler, and combinations thereof; and a balance of water;

the sizing composition having a pH ranging from 7 to 8 and excluding any other salts;

generating the recording sheet, including applying the sizing composition to the recording sheet such that the calcium propionate is present in an amount ranging from about 3 kg/ton of the recording sheet to about 15 kg/ton of the recording sheet; and during the applying, contacting a carbon steel part or a stainless steel part with the sizing composition, whereby a corrosion rate of any of the carbon steel part or the stainless steel part is improved when compared to a corrosion rate of any of the carbon steel part or the stainless steel part contacted with a second sizing composition including: a salt selected from the group consisting of calcium chloride alone, magnesium sulfate, calcium acetate, calcium lactate, and calcium nitrate; the same additive as the sizing composition; and a second balance of water; wherein the salt is present in the same amount or a different amount than the calcium propionate in the sizing composition, and wherein the second sizing composition has a second pH ranging from 7 to 8.

13. The method as defined in claim 12 wherein the selecting of the sizing composition includes selecting the sizing composition to further include the calcium chloride, wherein a ratio of the calcium chloride to the calcium propionate ranges from about from greater than 0:100 to 50:50.

14. The method as defined in claim 13 wherein the contacting of the carbon steel part or the stainless steel part with the sizing composition improves the corrosion rate of the any of the carbon steel part or the stainless steel part when compared to the corrosion rate of the any of the carbon steel part or the stainless steel part contacted with the second sizing composition including calcium chloride alone as the salt, wherein the calcium chloride amount in the second sizing composition is greater than the calcium chloride amount in the sizing composition.

15. The method as defined in claim 12 wherein a total amount of the calcium chloride and the calcium propionate ranges from about 5 kg/ton of the recording sheet to about 9 kg/ton of the recording sheet.

* * * * *